US006382449B1

(12) United States Patent
Kazmierski et al.

(10) Patent No.: US 6,382,449 B1
(45) Date of Patent: May 7, 2002

(54) TWO STAGE CUP

(75) Inventors: Michael S. Kazmierski, Cudahy; Ronald J. Wilson, Kewauskum, both of WI (US)

(73) Assignee: Paper Machinery Corporation, Milwaukee, WI (US)

( * ) Notice: Subject to any disclaimer, the term of this patent is extended or adjusted under 35 U.S.C. 154(b) by 0 days.

(21) Appl. No.: 09/825,641

(22) Filed: Apr. 4, 2001

(51) Int. Cl.[7] ..... B65D 21/00

(52) U.S. Cl. ..... 220/4.03; 220/8; 229/400; 229/403

(58) Field of Search ..... 220/4.03, 4.26, 220/8, 664; 229/400, 403, 405

(56) References Cited

U.S. PATENT DOCUMENTS

| | | | | |
|---|---|---|---|---|
| 3,079,027 A | | 2/1963 | Edwards | |
| 3,128,029 A | | 4/1964 | Price et al. | |
| 3,285,459 A | * | 11/1966 | Gahm | 220/8 |
| 3,471,058 A | * | 10/1969 | Latham et al. | 220/8 X |
| 4,231,476 A | | 11/1980 | Compton et al. | |
| 4,551,366 A | | 11/1985 | Marushashi et al. | |
| 5,385,260 A | * | 1/1995 | Gatcomb | 229/400 |
| 5,427,269 A | | 6/1995 | Willbrandt | |
| 5,433,337 A | | 7/1995 | Willbrandt | |
| 5,524,817 A | | 6/1996 | Meier et al. | |
| D372,839 S | | 8/1996 | Laib | |
| 5,632,406 A | * | 5/1997 | Robbins, III | 220/8 X |
| 5,657,897 A | | 8/1997 | Schwartzburg | |
| 5,752,653 A | | 5/1998 | Razzaghi | |
| 5,769,266 A | | 6/1998 | Willbrandt | |
| 5,860,557 A | | 1/1999 | Willbrandt | |
| 5,862,932 A | * | 1/1999 | Walsh et al. | 220/8 |

* cited by examiner

*Primary Examiner*—Steven Pollard
(74) *Attorney, Agent, or Firm*—Andrus, Sceales, Starke & Sawall, LLP

(57) ABSTRACT

A nestable beverage cup is preferably formed of two tapered sections. A lower section is sized to fit a cup holder such as used in a vehicle, while an upper section which is not held in the cup holder is provided with a larger diameter than the lower section, and is more broadly tapered to hold a greater volume of fluid. The lower section has a flattened rim which is ultrasonically sealed to the bottom of the upper section. A recessed bottom of the upper section provides an air gap which will insulate the user from the surface of the lower section. The two stage cup contemplates designs with various sidewalls, angles, shapes and raw materials.

12 Claims, 4 Drawing Sheets

TWO STAGE CUP

FIELD OF THE INVENTION

This invention relates generally to an improved container such as a food and beverage cup of the type commonly supported in automobiles, trucks and other vehicles. More particularly, the invention pertains to a two stage cup, preferably formed of paperboard, wherein an upper portion of a lower cup is uniquely joined to a lower portion of a substantially bottomless upper cup to provide enhanced integrity, insulation and other qualities.

BACKGROUND OF THE INVENTION

It is known that today's vehicles are equipped with one or more receptacles for holding generally cylindrical, food and beverage containers, such as cups and cans, so as to prevent their spillage while the vehicle is in transit. In order to accommodate containers of larger volumes, it has been necessary to consider cups designed with a base proportioned to fit the standard vehicle container receptacle having a main portion of a size larger than the base so as to address the problem of top heaviness of the filled container.

One such design is disclosed in U.S. Pat. No. 5,769,266, issued Jun. 23, 1998, to Willbrandt. In this patent, a one-piece container is comprised of a base and a lower body portion extending substantially upward from the base. A shoulder extends radially outward from the lower body portion and an upper body portion extends substantially upward from the shoulder. The upper body portion is open at the top to create an opening. The lower body portion has a size to fit in the standard vehicle container receptacle. The shoulder aids the container in securely nesting in the vehicle container receptacle. The upper body portion is of a size such that the container holds the desired amount of a beverage. In order to strengthen the sidewalls of the lower body portion and to facilitate material flow in the manufacture of the upper body portion, the lower body portion of the container is formed of a series of fluted sides that provide support to the lower body portion. The sides of the lower body portion increase in thickness as they extend upward from the base to the shoulder.

While the Willbrandt container has been generally satisfactory for use with cold beverages, its thermoplastic construction present several drawbacks, the first of which deals with its inability to provide satisfactory insulation for the holder of a hot beverage such as coffee or hot food product such as soup. As more and more people continue to ingest their meals in their vehicles, it is important to provide adequately insulated containers capable of comfortably handling a full temperature range of consumable products. As travelers may desire to reheat their food and beverages, the thermoplastic container is susceptible to deformation upon placement in a microwave oven. Once the thermoplastic container has been discarded, it does not exhibit the desirable biodegradability most favorable to the environment. Another disadvantage is recognized in the restricted ability and more expensive cost to print on the thermoplastic container. Because of the manner in which plastic is molded, printing is generally applied only to an upper portion of the container after it is formed.

Accordingly, there is a need for a different style, two stage container which can be securely accommodated in a standard vehicle container holder, mass produced at a reasonable cost and which otherwise overcomes the deficiencies in prior art containers as set forth above.

SUMMARY OF THE INVENTION

It is a general object of the present invention to provide a two stage cup preferably formed of paperboard having a lower section sized to fit a standard vehicle cup holder, and an upper section with a larger volume than the lower section.

It is one object of the present invention to provide a two stage cup which can be used with hot and cold beverages and foodstuffs.

It is also an object of the present invention to provide a two stage cup wherein the joinder of an upper cup and a lower cup provides improved insulative qualities and structural integrity.

It is a further object of the present invention to provide a two stage cup which is capable of being microwaved.

It is an additional object of the present invention to provide a two stage cup which is environmentally desirable.

It is a further object of the present invention to provide a two stage cup which offers greater flexibility in printing its outside surface.

Another object of the present invention is to provide a two stage cup wherein an upper cup section and a lower cup section have different sidewalls, angles, shapes, thicknesses, etc.

Still another object of the present invention is to provide a two stage cup which is easily nested and denested with one or more similar cups.

Yet another object of the present invention is to provide a two stage cup which fits into standard food and beverage dispensers.

A similar object of the present invention is to provide a two stage cup which is capable of mass production with existing cup producing equipment.

In one aspect of the invention, a two stage cup includes an upper cup having an upper cup sidewall disposed about a central axis and an upper cup bottom wall disposed generally transversely to the upper cup sidewall and punched out to define a bottom wall annular border extending radially inwardly from the upper cup sidewall. The upper cup sidewall has a top edge curled outwardly from the central axis and a lower cup has a lower cup sidewall and a lower cup bottom wall disposed generally transversely to the lower cup sidewall. The lower cup sidewall has a curled and flattened top edge lying in overlapping, sealed relationship with the upper cup bottom wall annular border, wherein a lower portion of the upper cup sidewall is spaced from an upper portion of the lower cup sidewall to create an insulative air gap, and the upper cup and the lower cup comprise paperboard. The upper cup sidewall is spaced from the lower cup sidewall 360° degrees about a circumference of the upper cup. The upper cup curled top edge is generally circular in cross section and is curled through 360° degrees. The upper cup top edge is curled in a direction generally outwardly of the central axis. The upper cup bottom wall annular border is spaced from the lower cup bottom wall by substantially the entire height of the lower cup sidewall. The lower cup sidewall and the lower cup bottom wall cooperate to form a recessed bottom. The upper cup has a volume larger than the lower cup. The upper cup sidewall tapers upwardly from the upper cup bottom wall annular border to the upper cup top edge, and the lower cup sidewall tapers upwardly from the lower cup bottom wall to the lower cup flattened top edge. The thickness of the upper cup sidewall is constant throughout its height, and the thickness of the lower cup sidewall is constant throughout its height.

In another aspect of the invention, a two stage container includes a lower cup comprised of paperboard and including a central axis, a lower cup sidewall and a lower cup bottom w all generally perpendicular to the central axis . An upper cup is comprised of paperboard and includes an upper cup sidewall and an upper cup bottom wall annular border extending generally perpendicular to the central axis and extending radially inwardly from the upper cup sidewall. The upper cup bottom wall annular border includes a first outer lip folded downwardly, generally transversely to the border, and the upper cup sidewall includes a first bottom flap folded upwardly over the first outer lip. The lower cup bottom wall includes a second outer lip folded downwardly, generally transversely to the bottom wall, and the lower cup sidewall includes a second bottom flap folded upwardly over the second outer lip to form a recessed bottom. The lower cup sidewall also has a flattened top edge which is disposed on top of the upper cup bottom wall annular border and is ultrasonically sealed thereto to join the upper cup above the lower cup. The first bottom flap on the upper cup sidewall is spaced from an upper portion of the lower cup sidewall to create an insulative air gap. The lower cup has a bottom region adapted to fit a cylindrically-shaped, vehicle container holder. The upper cup has an overall greater diameter than the lower cup.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
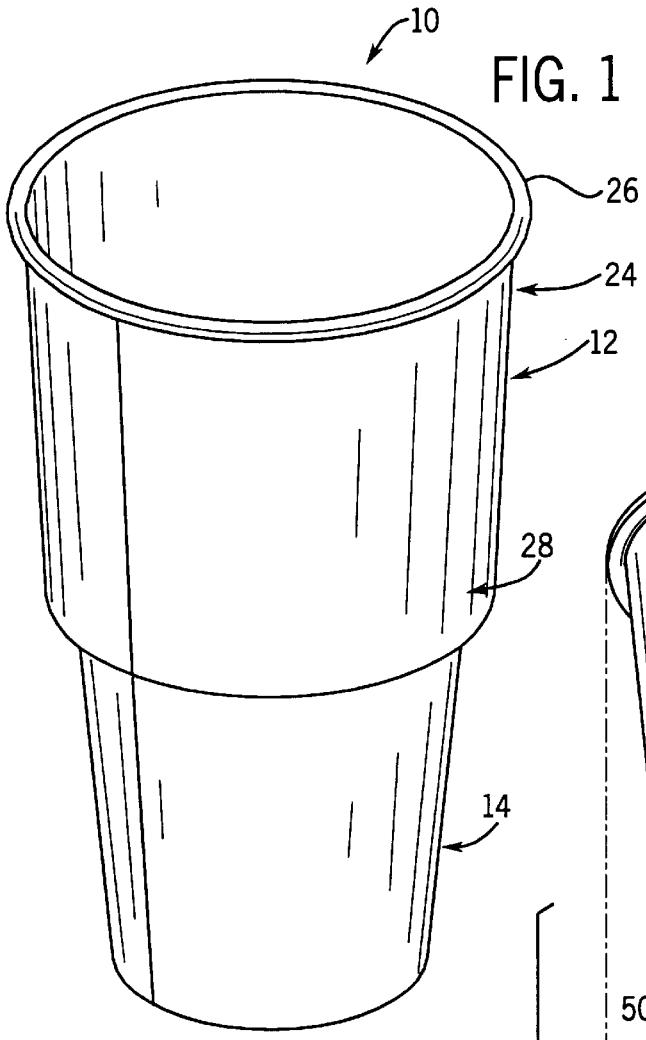
FIG. 1 is a perspective view of a two stage cup embodying the present invention.
Figure 2:
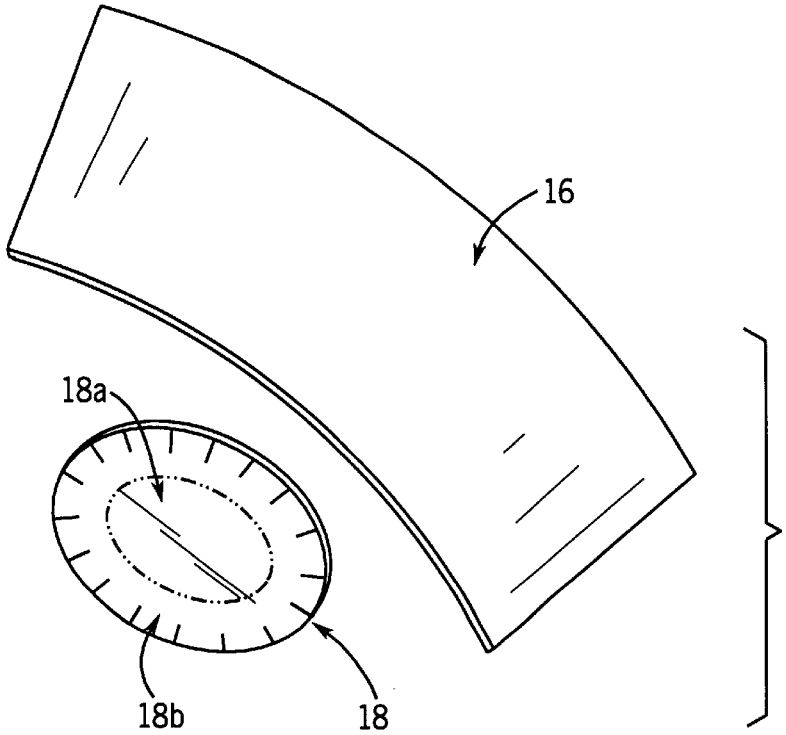
FIG. 2 is an exploded view of the sidewall blank and the bottom blank of the upper cup used in the container shown in FIG. 1.
Figure 3:
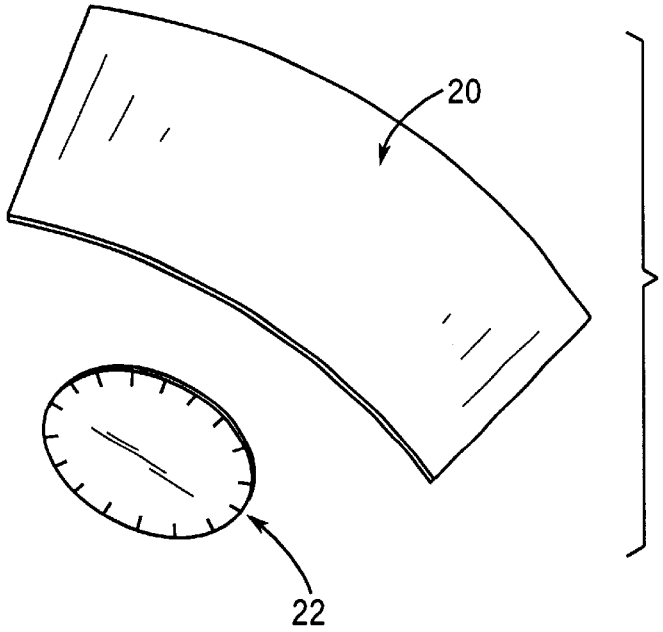
FIG. 3 is an exploded view of the sidewall blank and the bottom blank of the lower cup used in, the container illustrated in FIG. 1.

Referring generally to FIGS. 1–3, a two stage container 10 having an upper cup 12 and a lower cup 14 is shown. Upper cup 12 includes a sidewall blank 16 that forms its sidewall and a bottom blank 18 that forms its bottom wall, as best illustrated in FIG. 2. However, as will be further discussed below, a central portion 18*a* of bottom blank 18 is removed leaving a radially inwardly extending, annular border 18*b*. Lower cup 14 includes a sidewall blank 20 that forms its sidewall and a bottom blank 22 that forms its bottom wall, as best illustrated in FIG. 3. Unlike punched out bottom blank 18, bottom blank 22 remains solid.

Figure 4:
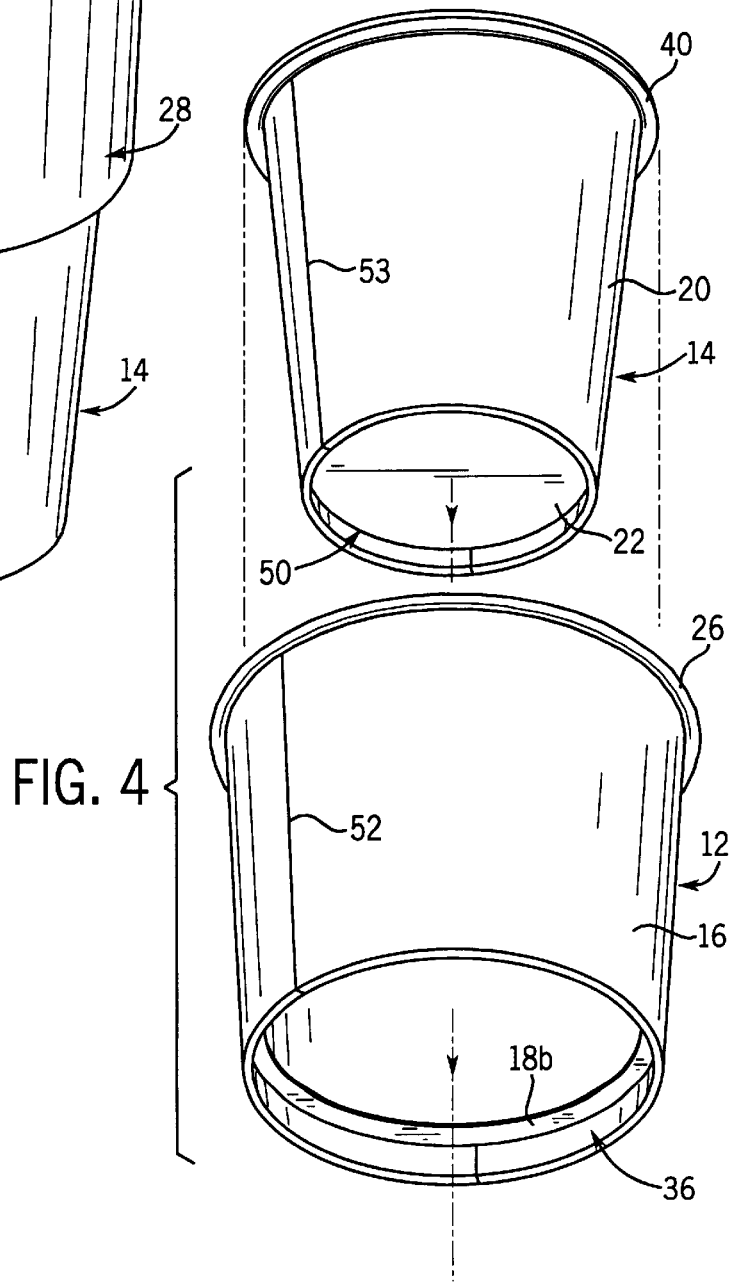
FIG. 4 is an exploded, inverted, perspective view of the assembly of the upper cup and the lower cup.
Figure 5:
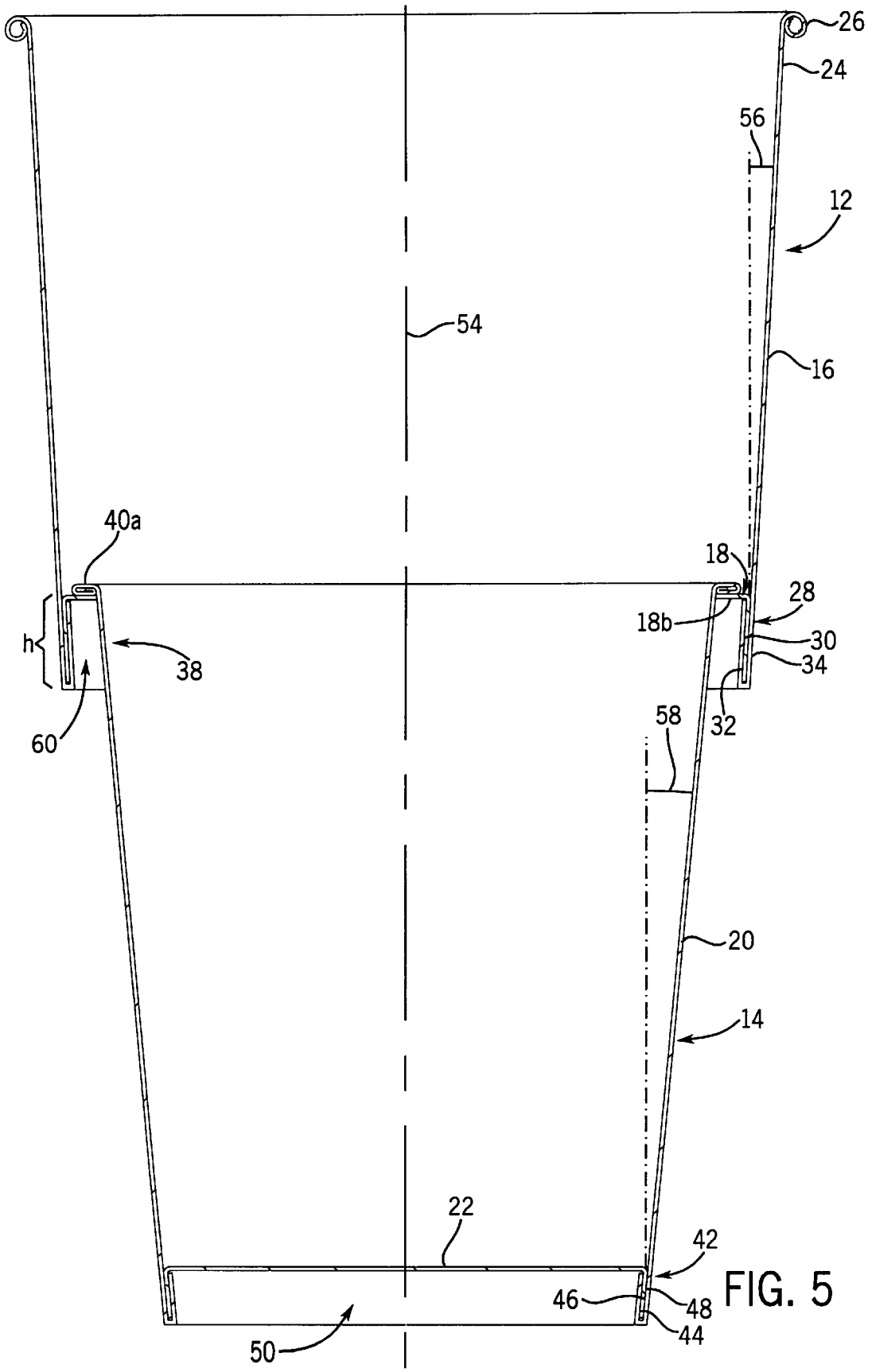
FIG. 5 is a cross-sectional view of the finished cup shown in FIG. 1.

As shown in FIGS. 4 and 5, an exemplary upper cup 12 includes an upper region 24 having a curled top edge 26 and a bottom region 28. Sidewall blank 16 is wrapped around punched out bottom blank 18 and disposed generally transversely thereto. Bottom blank 18 is typically bent or folded over in proximity to its outer edge to form a lip 30. The sidewall blank 16 is located with respect to punched out bottom blank 18 so a flap portion 32 of sidewall blank 16 extends beyond lip 30. Flap portion 32 is bent or folded around lip 30 so lip 30 may be squeezed between flap portion 32 and a lower portion 34 of sidewall blank 16. By forming upper cup 12 as illustrated in FIG. 4, a recessed bottom area 36 is created at the bottom of upper cup 12 on a lower side of bottom blank border 18*b*.

As shown in FIGS. 4 and 5, lower cup 14 includes an upper region 38 preferably having a top edge 40 (which is later flattened) and a bottom region 42. Lower sidewall blank 20 is wrapped around bottom blank 22 and disposed generally transversely thereto. Lower cup bottom blank 22 is typically bent or folded over in proximity to its outer edge to form a lip 44. The sidewall blank 20 is located with respect to bottom blank 22 so a flap portion 46 of sidewall blank 20 extends beyond lip 44. Flap portion 46 is bent or folded around 44 so lip 44 may be sandwiched between flap portion 46 and a lower region 48 of sidewall 20. By forming lower cup 14 as illustrated in FIG. 5, a recessed bottom area 50 is created in the bottom of lower cup 14 on an opposite side of bottom 22 from the main container of lower cup 14. Bottom region 42 is sized so as to provide a secure fit in a standard vehicle container receptacle.

Upper cup 12 and lower cup 14 are preferably fabricated from paperboard blanks which may be preprinted and have a thermoplastic coating, such as polyethylene. The thermoplastic material permits heating and sealing of adjacent components. For example, when upper cup sidewall blank 16 is wrapped around upper cup 12, punched out, bottom blank 18, the adjacent edges of sidewall blank 16 are heated and pressed together to form a seal 52. Similarly, lip 30, flap portion 32, and lower region 34 may be heated and pressed together to form a strong, leak-proof bottom region 28. This same approach may be used in the assembly of lower cup 14 so as to form a sidewall seal 53.

Upper cup 12 and lower cup 14 may be made from the same grades of paperboard. Typically, the sidewall blank and bottom blank of each cup are made from similar grades of paperboard, although differing grades could also be used for these elements as well.

Upper cup 12 is disposed about a central axis 54 that extends generally perpendicularly through the center of bottom blank 18. Preferably, when sidewall blank 16 is wrapped around bottom blank 18, sidewall 16 has a tapering section which is disposed at an acute angle 56 with respect to central axis 54 (see FIG. 5). Angle 56 can be increased or decreased for a specific application.

Upper cup 12 also includes curled top edge 26 that is formed by rolling or curling the top of sidewall blank 16 initially away from central axis 54 and then around and back towards the remaining portion of sidewall blank 16. Preferably, the curl extends through 180° degrees or more, and as illustrated, can curl through 360° degrees back to the remaining portion of sidewall blank 16 to form a generally circular cross section as illustrated in FIG. 5. It is an important method step that before the bottom blank 18 is joined to the sidewall blank 16, the central, preferably circular, portion 18*a* (FIG. 2) of bottom blank 18 is punched out and removed to facilitate assembly between the upper cup 12 and the lower cup 14.

Lower cup 14 includes curled top edge 40 which is radially flattened at 40*a* when upper cup 12 is combined with lower cup 14 as illustrated in FIGS. 4 and 5. Additionally, the sidewall 20 of lower cup 14 includes a tapered section that forms an acute angle 58 with central axis 54 when upper cup 12 and lower cup 14 are combined. In a preferred embodiment, both the upper and lower cups have frustroconical contours. Each cup preferably has its own constant sidewall thickness throughout its height. The volume of the upper cup 12 is generally larger than that of the lower cup 14.

Once the substantially bottomless upper cup 12 and the bottomed lower cup 14 have been formed, the upper cup 12 is passed over the lower cup 14 (as represented in FIG. 4) until the curled top edge 40 of lower cup 14 lies on top of the formed border 18*b* of lower cup. At this position, the edge 40 is radially flattened and then ultrasonically sealed to the border 18*b* to form a two stage container 10. When upper cup 12 and lower cup 14 are fastened together, leakage of food and beverage is prevented and the structural integrity of the container 10 is enhanced by the sealed and flattened edge 40*a* of the lower cup 14 as it is fused to the upper cup 12. Simultaneously, there is provided an air gap 60 between the recessed bottom of the upper cup 12 and the upper region of the lower cup 14 which will insulate the user from any hot contents in the container 10. Air gap 60 extends for 3600 degrees around the circumference of lower cup 14 and over a significant vertical height h (typically one-half inch) so as to provide container 10 with substantial insulating ability. The hand can hold the cup comfortably without excessive heat or burning.

The resulting versatile cup is thus capable of holding varying volumes of both hot and cold beverages and foodstuffs. It is also possible that the lower portion of cup 10 could be filled with a granular or powdered soup or cereal mix and fitted with a temporary seal which could be removed to enable the user to add a hot water diluent in the upper portion of the cup 10. Advantageously, cup 10 is designed to retain its sealing and strength features while being microwaved. Because of its paperboard construction, the cup has a reasonable degree of biodegradability which will not harm the environment.

One of the benefits of utilizing paperboard in the fabrication of container 10 is the ability to preprint the respective, flattened sidewall blanks 16, 20 of both the upper cup 12 and the lower cup 14 before the sidewall blanks are formed and sealed with their respective bottom blanks 18, 22. Consequently, the upper cup 12 and the lower cup 14 may carry similar or different logos, graphics, indicia, etc. of high printing quality. This is contrast to the prior art thermoplastic cup which is generally partially printed by a different, more expensive method after the cup has been molded. That is, the upper surface of the plastic cup is printed as the cup is turned which can effect the quality of the ink transfer.

Figure 6:
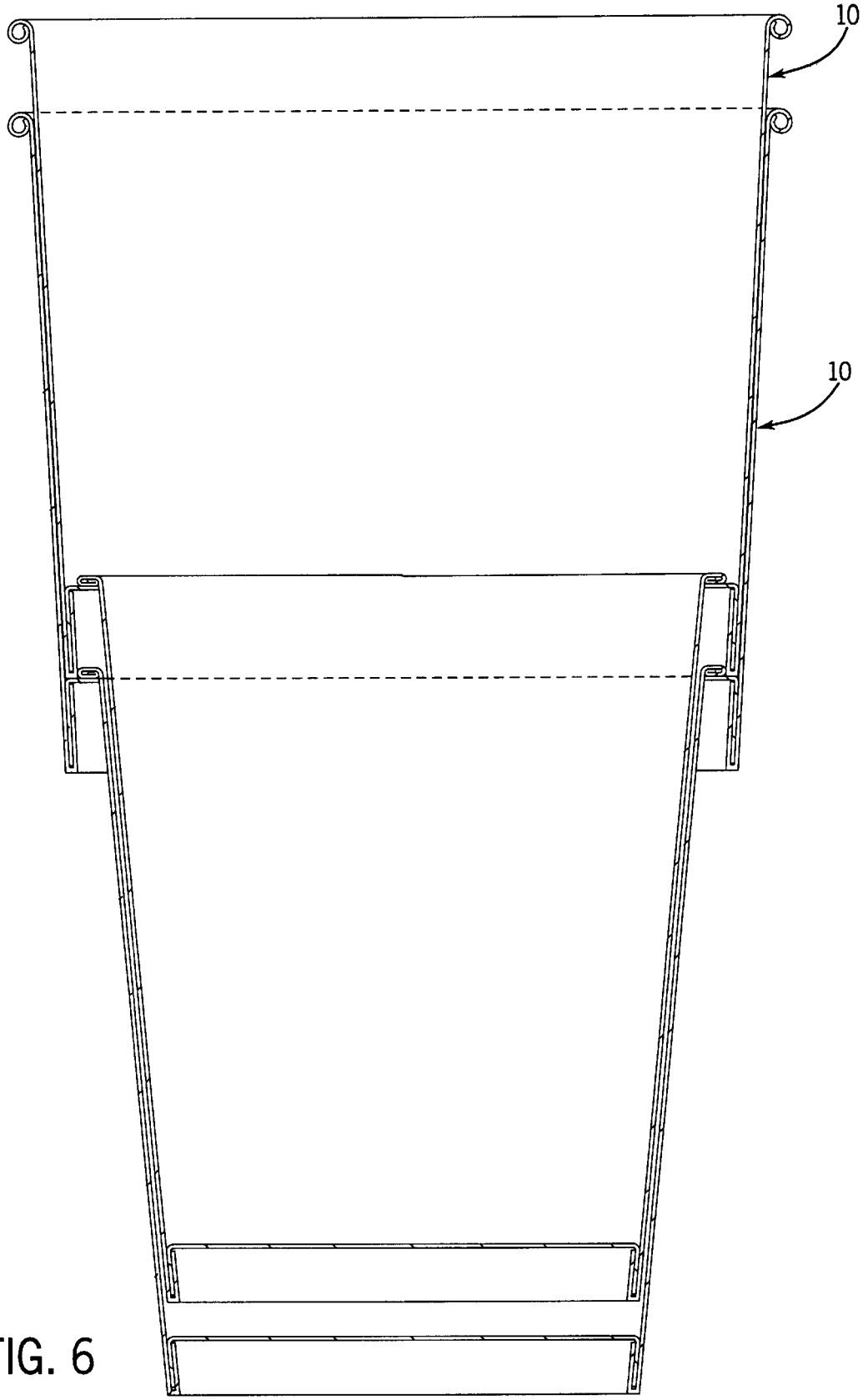
FIG. 6 is a cross-sectional view of two nested cups of the type shown in FIG. 1.

FIG. 6 illustrates a pair of formed two stage cups 10 which are in nesting relationship with one another. It should be understood that denesting can be controlled by the shape of the upper cup 12 or the lower cup 14. The cups 10 are thus formed to permit their vertical or horizontal stacking when they are also used in conjunction with beverage or food dispensing equipment such as found in fast food establishments.

It will be understood that the foregoing description is of a preferred exemplary embodiment of this invention and that the invention is not limited to the specific forms shown. For example, various grades of paperboard and other materials may be used in the construction of either the upper cup or the lower cup; the upper cup and lower cups may each be provided with recessed bottoms or bottoms of other configurations; the curled top edge of the upper cup can have a variety of configurations, the lower cup can have either straight or tapered sidewall or sidewall sections; the lower cup can have varying degrees tapered to its sidewall; and the cups can have circular, elliptical, rectangular or other cross-sectional shapes depending on the overall shape of the container. For example, the lower cup may be conical, while the upper cup may be rectangular. These and other modifications may be made in the design and arrangement of the elements without departing from the scope of the invention as expressed in the appended claims.

We claim:

1. A two stage cup comprising:

an upper cup having an upper cup sidewall disposed about a central axis and an upper cup bottom wall disposed generally transversely to the upper cup sidewall and punched out to define a bottom wall, annular border extending radially inwardly from the upper cup sidewall, the upper cup sidewall having a top edge curled radially from the central axis; and a lower cup having a lower cup sidewall disposed about the central axis and a lower cup bottom wall disposed generally transversely to the lower cup sidewall, the lower cup sidewall having a curled and flattened top edge lying in overlapping, sealed relationship with the upper cup bottom wall annular border, wherein a lower portion of the upper cup sidewall is spaced from an upper portion of the lower cup sidewall to create an insulative air gap, and the upper cup and the lower cup comprise paperboard.

2. The cup of claim 1, wherein the upper cup sidewall is spaced from the lower cup sidewall through 360° degrees about a circumference of the upper cup.

3. The cup of claim 1, wherein the upper cup curled top edge is generally circular in cross section and is curled outwardly through 360° degrees.

4. The cup of claim 1, wherein the upper cup top edge is curled in a direction generally outwardly of the central axis.

5. The cup of claim 1, wherein the upper cup bottom wall annular border is spaced from the lower cup bottom wall by substantially the entire height of the lower cup sidewall.

6. The cup of claim 1, wherein the lower cup sidewall and the lower cup bottom wall cooperate to form a recessed bottom.

7. The cup of claim 1, wherein the upper cup has a volume larger than the lower cup.

8. The cup of claim 1, wherein the upper cup sidewall tapers upwardly from the upper cup bottom wall annular border to the upper cup top edge, and the lower cup sidewall tapers upwardly from the lower cup bottom wall to the lower cup flattened top edge.

9. The cup of claim 1, wherein the thickness of the upper cup sidewall is constant throughout its height, and the thickness of the lower cup sidewall is constant throughout its height.

10. A two stage container comprising:

a lower cup comprised of paperboard and including a central axis, a lower cup sidewall and a lower cup bottom wall generally perpendicular to the central axis;

an upper cup comprised of paperboard and including an upper cup sidewall and an upper cup bottom wall annular border extending perpendicularly to the central axis and extending radially inwardly from the upper cup sidewall, wherein the upper cup bottom wall annular border includes a first outer lip folded downwardly, generally transversely to the border, and the upper cup sidewall includes a first bottom flap folded upwardly over the first outer lip;

wherein the lower cup bottom wall includes a second outer lip folded downwardly, generally transversely to the bottom wall, and the lower cup sidewall includes a second bottom flap folded upwardly over the second outer lip to form a recessed bottom;

wherein the lower cup sidewall also has a flattened top edge which is disposed on top of the upper cup bottom wall annular border and ultrasonically sealed thereto to join the upper cup above the lower cup; and wherein the first bottom flap on the upper cup sidewall is spaced from an upper portion of the lower cup sidewall to create an insulated air gap.

11. The container of claim 10, wherein the lower cup has a bottom region adapted to fit a cylindrically-shaped, vehicle container holder.

12. The container of claim 10, wherein the upper cup has an overall greater diameter than the lower cup.

* * * * *